US007129963B2

(12) United States Patent
Böhnisch et al.

(10) Patent No.: US 7,129,963 B2
(45) Date of Patent: Oct. 31, 2006

(54) DEVICE FOR AUDIOVISUAL PRESENTATION OF SOUND AND IMAGES

(75) Inventors: Wolfgang Böhnisch, Munich (DE); Rudolf Redllch, Munich (DE); Daniel Steinbichler, Pöttmes (DE)

(73) Assignee: GTG Gesellcraft für elektronische Geräte mbH, Planegg (DE)

( * ) Notice: Subject to any disclaimer, the term of this patent is extended or adjusted under 35 U.S.C. 154(b) by 155 days.

(21) Appl. No.: 10/806,600

(22) Filed: Mar. 23, 2004

(65) Prior Publication Data

US 2004/0189596 A1 Sep. 30, 2004

(30) Foreign Application Priority Data

Mar. 24, 2003 (DE) ..... 103 13 023

(51) Int. Cl.
*G09G 5/00* (2006.01)

(52) U.S. Cl. ..... 345/649

(58) Field of Classification Search ..... 345/649, 345/659, 652, 655, 657; 382/296, 297
See application file for complete search history.

(56) References Cited

U.S. PATENT DOCUMENTS 5,250,888 A * 10/1993 Yu ..... 318/640
5,973,664 A * 10/1999 Badger ..... 345/659
6,348,928 B1 * 2/2002 Jeong ..... 345/649
6,801,426 B1 * 10/2004 Ichimura ..... 361/681
6,891,920 B1 * 5/2005 Minyard et al. ..... 378/37
6,931,596 B1 * 8/2005 Gutta et al. ..... 715/728
2002/0109665 A1 * 8/2002 Matthews et al. ..... 345/156
2002/0126110 A1 * 9/2002 Bowron ..... 345/204
2003/0202003 A1 * 10/2003 Marmaropoulos ..... 345/710
2003/0222848 A1 * 12/2003 Solomon et al. ..... 345/156
2004/0039862 A1 * 2/2004 Hunt et al. ..... 710/304

FOREIGN PATENT DOCUMENTS

DE 299 10 085 U1 10/1999
DE 199 60 544 A1 7/2001

* cited by examiner

*Primary Examiner*—Ulka Chauhan
*Assistant Examiner*—Daniel C. Washburn
(74) *Attorney, Agent, or Firm*—Quarles & Brady LLP

(57) ABSTRACT

A device for audiovisual presentation of sound and images, particularly for advertising purposes, with a memory unit (14) and a monitor (10) to display image information from the memory unit (14). An actuator unit (11) is provided to move the monitor, and a control unit (12) controlling the actuator unit (11) depending upon the image information displayed on the monitor (10) controls movement of the monitor (10).

17 Claims, 2 Drawing Sheets

DEVICE FOR AUDIOVISUAL PRESENTATION OF SOUND AND IMAGES

CROSS REFERENCES TO RELATED APPLICATIONS

Not Applicable.

STATEMENT REGARDING FEDERALLY SPONSORED RESEARCH

Not Applicable.

DESCRIPTION OF THE BACKGROUND ART

The present invention involves a device for audiovisual presentation of sound and images, particularly for advertising purposes, with a memory unit and a monitor for displaying image information from the memory unit.

Audiovisual presentations are a familiar use of monitors or displays that are available in the form of CRTs, or increasingly flat monitors, primarily LCD and TFT flat monitors. Monitors are used, for example, to present advertising offers in stores, at exhibitions, and in public transportation. These monitors are usually positioned in a stationary manner at the location, and supplied with sound and image material from a video player or a DVD player. This video information is usually displayed on the monitor without a change in the configuration as recorded on the data medium. This widely disseminated type of presentation has lost a great deal of its attractiveness through many years of unchanged usage, not least because the use of television in the home has accustomed the addressed public to this type of presentation; in other words, such presentations usually no longer attract any particular degree of attention.

Thus there exists a need for an audiovisual presentation device that is appropriate for attracting attention from both technical audiences and consumers with regard to advertising offers.

SUMMARY OF THE INVENTION

One aim of the present invention is therefore to create a device for audiovisual presentation of sound and images of the type specified above that is a highly efficient advertising platform. This aim is achieved by the features of Claim 1. Advantageous improvements of the invention are specified in the subclaims.

In other words, the invention as defined in Claim 1 provides a completely new type of audiovisual presentation device, in which the image and sound contents are matched to the movement of the presentation medium, i.e. the monitor. The product being advertised thereby remains constantly in view and the monitor offers a highly efficient advertising platform. Because the presentation medium in the form of the monitor according to the invention represents the medium of the presentation, it draws the attention of the relevant public, either technical audiences or consumers, to a degree that cannot be achieved by existing audiovisual presentation devices with static monitors because of the acclimatization effect caused by many years of exposure.

According to a preferred embodiment of the invention, the monitor actuator unit comprises a rotary actuator to rotate the monitor from an axis vertical to the monitor, preferably around the center of the monitor, so that this presentation medium can be correlated with the image information and if necessary with the sound information.

According to the invention, the movement, in this case the rotational movement of the monitor, is alternatively or additionally based upon the presentation of the image and/or sound on the monitor.

In other words, the image information read from the monitor memory unit is modified based upon the monitor movement and/or position, primarily through the splitting and reassembly/synthesis of the split image content depending upon the monitor movement. During a movement segment of the monitor, for example, the image information displayed on the monitor is subdivided into image segments, which are moved apart from one another during a further rotation of the monitor and are then reassembled to form the original image during a subsequent movement of the monitor.

This dynamic image generation depending upon the monitor movement represents a new type of presentation form that spontaneously draws an observer into the action occurring on the monitor. A transmission of the image content to the monitor movement, in this case the rotational movement of the monitor, in order to modify this movement, leads to a similarly visually interesting effect. For example, the monitor can follow in an attractive manner the route of a skier or a bobsled, while simulating the rhythmic movement of this sporting equipment through a limited clockwise and counterclockwise angular rotation of the monitor.

The rotary actuator provided for the rotational movement of the monitor preferably comprises a low-friction pivot bearing in order to achieve a rotational movement of the monitor in any desired speed, acceleration, and direction.

In the case of a rotatable monitor, a rotation transmitter is advantageously provided for the signals and/or data transmitted between control unit and the monitor and/or its power supply. Alternatively, the signal and/or data transfer can also be contactless.

According to a particularly advantageous aspect of the invention, the correlation between the monitor movement and the image information occurs through the implementation of a control loop for synchronization of monitor movement and image information. The control loop for dynamic synchronization of the monitor movement with the image information is preferably designed such that, in addition to a constant speed of this movement (e.g. rotational movement), its acceleration and deceleration can also be defined by the user.

According to an advantageous improvement of this aspect of the invention, the control loop provides for bi-directional data transmission between the monitor actuator unit and control unit, while continuously comparing the actual value of the image information with the target value of the monitor movement and the actual value of the monitor movement with the target value of the image information. The control loop according to the invention is preferably created in the form of programmable software.

The control loop and/or control unit is preferably implemented with the incorporation of a computer, primarily a personal computer. In this case, the image information and, if necessary the sound information is stored in a memory unit of the computer, as are the movement data for the monitor actuator. Within the computer, a content player (or a data playback device) supplied by the content of the memory unit is implemented, primarily as software, and plays back the image and, if necessary, the sound data stored in the computer's memory unit, as well as movement data based upon timeline data (signal pulse data or time code data), which is also stored in the memory unit.

Furthermore, a movement player (e.g. in the form of software) is preferably implemented in the computer, and communicates bi-directionally with the output of the content player and the monitor actuator unit based upon a shared activation signal for the memory unit, the content player, and the movement player.

The sound information is preferably incorporated via computer into the control of the monitor actuator.

In order to ensure that the monitor being moved according to the invention does not present a safety risk, the invention provides for safety information, primarily with respect to maximum speed, acceleration, and safe distance from the surroundings, to be exchanged between the actuator unit and/or the monitor and control unit, whereby the actuator unit is shut down if the maximum values are exceeded.

In order to minimize the size and weight of the monitor, while still ensuring an optimally large monitor display, the monitor is preferably a matrix display, primarily a plasma or LCD display.

BRIEF SUMMARY OF THE DRAWINGS

The invention is described in greater detail below based upon the drawings; these are.

DETAILED DESCRIPTION OF THE PREFERRED EMBODIMENTS

Figure 1:
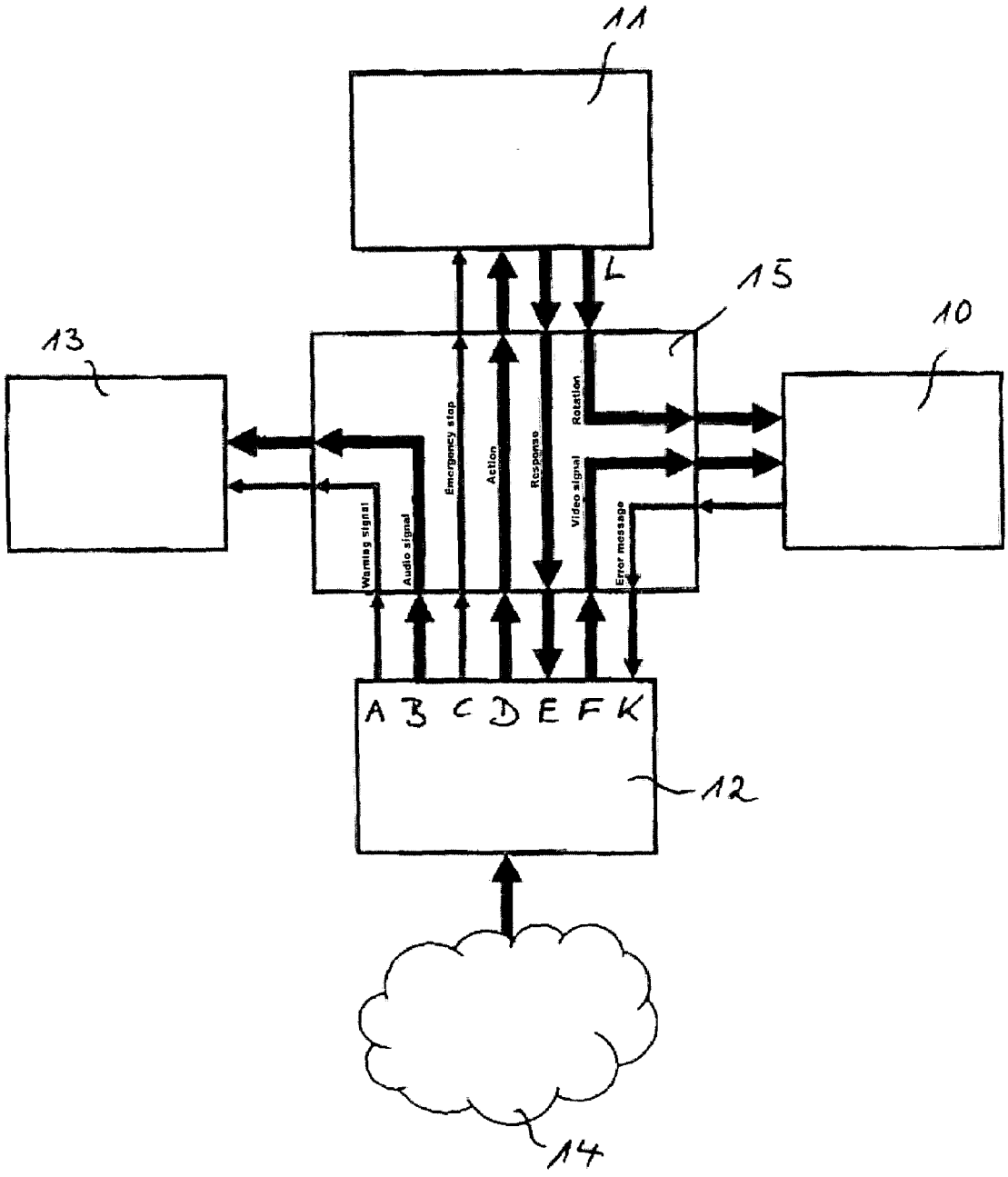
FIG. 1, showing a schematic diagram of the audiovisual presentation device according to the invention, and FIG. 2, showing a more detailed process schematic of the device in FIG. 1.

The audiovisual presentation device shown in FIG. 1 comprises a monitor 10, preferably in the form of a matrix display such as a plasma or LCD display, an actuator unit 11 to move the matrix display 10, a control unit 12 to control the movement of the monitor 10 via the actuator unit 11, and an audio unit 13 to play back the sound information. Sound and image information, as well as, movement data are stored, preferably in digital format, in a memory unit 14, which is in data communication with control unit 12, as indicated by an arrow that begins at memory unit 14 and points to control unit 12.

Control unit 12 is in communication, partially two-way communication, with the monitor 10, actuator unit 11, and audio unit 13, as indicated by arrows, and the entirety of this means of communication is schematically summarized in FIG. 1 as the central communication unit 15. The communication connections of control unit 12 are indicated by the letters A, B, C, D, E, F, and K, and constitute the starting or ending point, respectively, of the arrows used in FIG. 1 to indicate communication.

In detail, A designates a communication line from control unit 12 to audio unit 13, and this communication line is used to transmit a warning signal from control unit 12 to audio unit 13. This warning signal is generated in control unit 12 together with an error message signal, which originates from the monitor 10 and is transmitted via communication line K to control unit 12. An audio signal is transmitted from memory unit 14 by means of control unit 12 via communication line B to audio unit 13. A Non stop activation signal is transmitted from control unit 12 to actuator unit 11 via communication line C.

An action signal is transmitted by control unit 12 via communication line D to actuator unit 11. A response signal corresponding to this action is transmitted from actuator unit 11 via communication line E to control unit 12. A video signal is transmitted via communication line F from control unit 12 (coming from memory unit 14) to the monitor 10. A further communication line L exists, which proceeds from actuator unit 11 to the monitor 10 and schematically represents the movement that actuator unit 11 transmits to the monitor 10.

The audiovisual presentation device shown schematically in FIG. 1 is used to move the monitor 10 via actuator unit 11 depending upon the image information stored in the image memory unit, and conversely to transmit the monitor movement via actuator unit 11 to control unit 12, in order to modify in this way the image and/or sound/audio data depending upon the monitor movement, for example to split them into segments and then reassemble them into a complete image depending upon the subsequent course of movement of the monitor 10.

Figure 2:
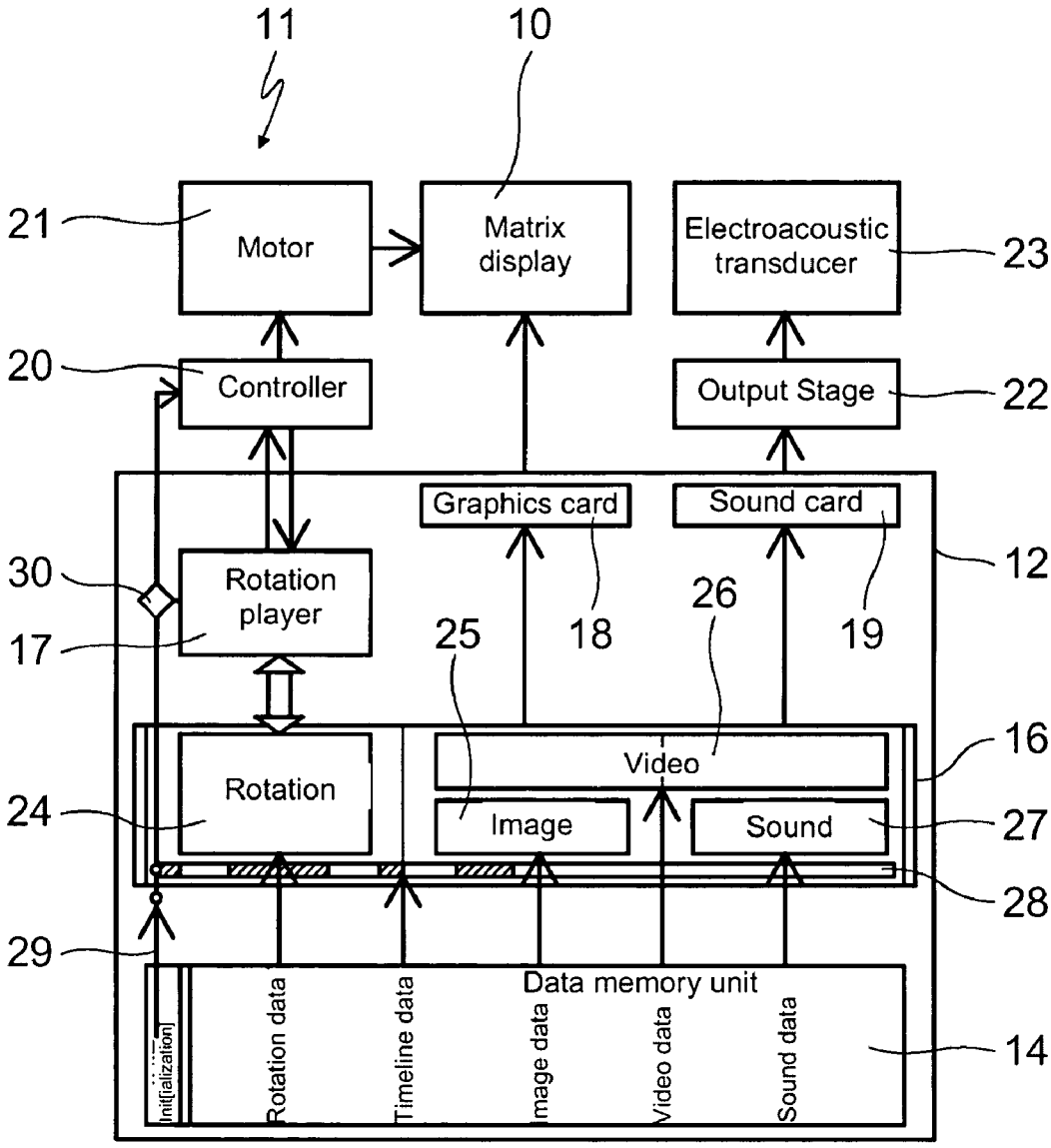

The control of the monitor and its actuator via control unit 12 based upon the data provided in memory unit 14 is explained in greater detail below with reference to FIG. 2. FIG. 2 shows control unit 12 in the form of a computer, preferably a personal computer, which contains data memory unit 14 in the form of a hard disk drive. On the output side, the data memory unit 14 is connected to an intermediate unit, which in this case is described as the content player (data playback unit) 16. This content player 16 has three outputs, of which the first is connected to a movement player, in the present case a rotation player 17. The connection between rotation player 17 and content player 16 is a bi-directional connection. The second output of content player 16 is connected to a graphics card 18, and the third output of content player 16 is connected to a sound card 19.

The rotation player 17 has a bi-directional output, which is connected to a controller 20, preferably external, which in turn is connected on its output side with an electrical motor 21 of actuator unit 11. In a manner similar to motor 21, controller 20 is preferably integrated into actuator unit 11, which in other respects is connected as an actuator to the monitor 10, in order to rotate the latter in the present embodiment around a vertical axis extending through its center. For this purpose, a rotary actuator connection exists between the center of the monitor 10 and electrical motor 21. Signals between electrical motor 21 and the monitor 10 are transmitted via a rotation transmitter, for example, or in a contactless manner. The power supply for the monitor 10 is likewise transmitted by a rotation transmitter or by the rotation transmitter for the signal transmission from electrical motor 21 to the monitor 10. Corresponding image information is sent from graphics card 18 to the monitor 10.

The output of sound card 19 is connected with an external output stage or power amplifier 22, which on its output side drives an electroacoustic transducer 23. Power amplifier 22 is preferably integrated into electroacoustic transducer 23.

Memory unit 14 contains rotation data that is fed to a rotation section 24 (generally a movement section) of content player 16. In a similar manner, image data contained in memory unit 14 is fed to an image section 25 of content player 16. Video data is fed to a corresponding video section 16 of content player 16. The image data and the video data that are fed to image section 25 and video section 26 of content player 16 consist of image information, the first being static image information (25), and the second being full-motion image information (26). Sound data contained in memory unit 14 are fed to a sound section 27 of the content player. Data from image section 25 and video section 26 is each fed into graphics card 18, and data from sound section 27 is fed into sound card 19.

Memory unit 14 also stores timeline data (signal pulse data and/or time synchronization data), which is fed to a timeline 28 in content player 16 and used to synchronize the data of the content player with one another and with rotation player 17, or external motor 21, and the monitor 10 position, as explained in greater detail below. In addition, initialization signals are fed by the memory unit via an initialization signal line 29 to content player 16, rotation player 17, and controller 20.

Rotation player 17 is connected to a limit-value memory unit 30, which stores the maximum values for the rotation signals fed by rotation player 17 to electrical motor 21 via controller 20; these maximum values are continuously compared with the actual values of rotation player 17, and if necessary can be used to block its output signals in order to prevent undesired movement patterns or conditions of the monitor 10, which is put into rotation via motor 11.

The functioning of the audiovisual presentation device shown in FIG. 2 is described in greater detail below. The device according to the invention as shown in FIG. 2 is especially designed to dynamically synchronize its hardware components. Because the aim is to control the monitor movement and image information for the monitor in a mutually dependent manner to create a highly efficient advertising platform, a conventional distribution of image (and sound) contents as well as control signals to actuator unit 11 is insufficient, because the chronological playback behavior depends upon several factors of the hardware components, such as resolution (particularly of the monitor screen), different data formats, etc., and because no chronological prediction is possible. For this reason, a control loop is implemented, which dynamically synchronizes the image content and the movement, in the present case the rotational movement of the monitor. As shown in FIG. 2, this control loop is bi-directional. In other words, it continuously compares both the actual value of the image content with the target value of the rotational movement, and the actual value of the rotational movement with the target value of the image content.

In this case, the dynamic of the synchronization means that in addition to the constant angular velocity (general movement speed), acceleration and deceleration of the monitor rotation can also be defined by the user.

The control loop essentially consists of players 16 and 17 and control unit 12 from FIG. 2. Players 16 and 17, i.e. the content player and the rotation player, which are preferably realized in the form of software, communicate via specialized software. The actuator action, i.e. the angular velocity, the acceleration, the deceleration, and the rotational direction of electrical motor 21 and thus the monitor 10, are transmitted from the rotation player to the motor control, and the response (the angular position) is simultaneously confirmed to the rotation player via this route. In this way, any desired rotation of the monitor 10 can be controlled by means of the rotation data stored in memory unit 14, depending upon the image information (image data and/or video data) stored in this memory unit. In the other direction, the rotational movement of monitor 10 can be used to modify the image information and, if necessary, the sound information.

REFERENCE NUMBER LIST

10 Monitor
11 Actuator unit
12 Control unit
13 Audio unit
14 Memory unit
15 Central communication unit
16 Content player
17 Rotation player
18 Graphics card
19 Sound card
20 Controller
21 Electrical motor
22 Output stage
23 Electroacoustic transducer
24 Rotation section
25 Image section
26 Video section
27 Sound section
28 Timeline
29 Initialization signal line

We claim:

1. A device for audiovisual presentation of sound and images, particularly for advertising purposes, with a memory unit (14) and a monitor (10) to display image information from the memory unit (14), said device comprising:

an actuator unit (11) to move the monitor (10); and a control unit (12) controlling said actuator unit (11) to dynamically synchronize movement of the monitor (10) with the image information displayed on the monitor (10), said control unit (12) including a control loop synchronizing the monitor movement caused by said actuator unit (11) with the image information, wherein the control loop is designed for dynamic synchronization of the monitor movement with the image information such that in addition to a constant speed of this movement, its acceleration and deceleration can be defined by the user.

2. The device as defined in claim 1, wherein the control loop provides for bi-directional data transmission between the monitor actuator unit (11) and the control unit (12) with continuous comparison of the actual value of image information with the target value of monitor movement and the actual value of the monitor movement with the target value of the image information.

3. The device as defined in claim 1, wherein control unit (12) is designed so as to modify the image information read from the memory unit (14) depending upon the monitor movement, primarily to split and reassemble the image information being displayed on the monitor (10).

4. The device as defined in claim 1, wherein the monitor actuator unit (11) comprises a rotary actuator which rotates the monitor (10) about a vertical axis.

5. The device as defined in claim 4, wherein the rotary actuator comprises a low-friction pivot bearing for unrestricted rotation of the monitor (10).

6. The device as defined in claim 4, wherein the actuator unit (11) comprises a rotation transmitter which can transmit signals/data between the control unit (12) and at least one of the monitor (10) and a power supply.

7. The device as defined in claim 1, wherein a contactless signal/data transmission exists between the monitor (10) and the control unit (12).

8. The device as defined in claim 1, wherein the monitor (10) is a matrix display.

9. The device as defined in claims 1, wherein the control unit (12) comprises a computer, and said image information is stored in a memory unit (14) of the computer.

10. The device as defined in claim 9, wherein a content player (16) is implemented in the computer and supplied by the content of the memory unit (14), and plays back the image information for display on the monitor (10) and movement data based upon timeline data stored in the memory unit (14) of the computer to synchronize movement of the monitor with said image information being displayed on the monitor (10).

11. The device as defined in claim 10, wherein a movement player (17) is implemented in the computer and communicates bi-directionally with the output of the content player (16) and the monitor actuator unit (11) based upon a shared activation signal for the memory unit (14), content player (16), and movement player (17).

12. The device as defined in claim 1, wherein sound information is incorporated into the control of the actuator unit (11).

13. The device as defined in claim 1, wherein safety information including a maximum value for at least one of speed, acceleration, and safe distance to the surroundings of said monitor (10) is exchanged between the actuator unit (11) and the control unit (12), and the actuator unit (11) is shut down if said maximum value is exceeded.

14. A device for audiovisual presentation of sound and images, particularly for advertising purposes, with a memory unit (14) and a monitor (10) to display image information from the memory unit (14), said device comprising:

an actuator unit (11) to move the monitor (10); and a control unit (12) controlling said actuator unit (11), said control unit including a control loop synchronizing the monitor movement caused by said actuator unit (11) with the image information, wherein the control loop provides for bi-directional data transmission between the monitor actuator unit (11) and the control unit (12) with continuous comparison of the actual value of image information with the target value of monitor movement and the actual value of the monitor movement with the target value of the image information.

15. The device as defined in claim 14, wherein control unit (12) is designed so as to modify the image information read from the memory unit (14) depending upon the monitor movement, primarily to split and reassemble the image information being displayed on the monitor (10).

16. A device for audiovisual presentation of sound and images, particularly for advertising purposes, with a memory unit (14) and a monitor (10) to display image information from the memory unit (14), said device comprising:

an actuator unit (11) to move the monitor (10); and a control unit (12) controlling said actuator unit (11), said control unit including a control loop synchronizing the monitor movement caused by said actuator unit (11) with the image information, wherein the control loop is designed for dynamic synchronization of the monitor movement with the image information such that in addition to a constant speed of this movement, its acceleration and deceleration can be defined by the user.

17. The device as defined in claim 16, wherein control unit (12) is designed so as to modify the image information read from the memory unit (14) depending upon the monitor movement, primarily to split and reassemble the image information being displayed on the monitor (10).

* * * * *